United States Patent [19]

McDowell

[11] 4,191,628

[45] Mar. 4, 1980

[54] PROCESS FOR REMOVAL OF MINERAL PARTICULATES FROM COAL-DERIVED LIQUIDS

[75] Inventor: William J. McDowell, Knoxville, Tenn.

[73] Assignee: The United States of America as represented by the United States Department of Energy, Washington, D.C.

[21] Appl. No.: 950,875

[22] Filed: Oct. 12, 1978

[51] Int. Cl.[2] ..... C10G 1/06; C10G 29/12; C10G 29/06

[52] U.S. Cl. ..... 208/8 R; 208/177

[58] Field of Search ..... 208/8 R, 177, 8 LE, 208/10

[56] References Cited

U.S. PATENT DOCUMENTS

| | | | |
|---|---|---|---|
| 3,677,932 | 7/1972 | Hardesty et al. | 208/10 |
| 3,736,250 | 5/1973 | Berg et al. | 208/10 |
| 3,844,928 | 10/1974 | Geymer | 208/8 R |
| 4,057,484 | 11/1977 | Malek | 208/8 R |
| 4,085,029 | 4/1978 | Malek | 208/8 LE |
| 4,092,236 | 5/1978 | Heredy | 208/8 R |

FOREIGN PATENT DOCUMENTS

| | | | |
|---|---|---|---|
| 2543527 | 4/1976 | Fed. Rep. of Germany | 208/8 R |

*Primary Examiner*—George Crasanakis
*Attorney, Agent, or Firm*—R. V. Lupo; Stephen D. Hamel; Allen H. Uzzell

[57] ABSTRACT

Suspended mineral solids are separated from a coal-derived liquid containing the solids by a process comprising the steps of: (a) contacting said coal-derived liquid containing solids with a molten additive having a melting point of 100°-500° C. in an amount of up to 50 wt. % with respect to said coal-derived liquid containing solids, said solids present in an amount effective to increase the particle size of said mineral solids and comprising material or mixtures of material selected from the group of alkali metal hydroxides and inorganic salts having antimony, tin, lithium, sodium, potassium, magnesium, calcium, beryllium, aluminum, zinc, molybdenum, cobalt, nickel, ruthenium, rhodium or iron cations and chloride, iodide, bromide, sulfate, phosphate, borate, carbonate, sulfite, or silicate anions; and (b) maintaining said coal-derived liquid in contact with said molten additive for sufficient time to permit said mineral matter to agglomerate, thereby increasing the mean particle size of said mineral solids; and (c) recovering a coal-derived liquid product having reduced mineral solids content. The process can be carried out with less than 5 wt. % additive and in the absence of hydrogen pressure.

22 Claims, No Drawings

PROCESS FOR REMOVAL OF MINERAL PARTICULATES FROM COAL-DERIVED LIQUIDS

This invention was made in the course of, or under, a contract with the United States Department of Energy.

BACKGROUND OF THE INVENTION

This invention relates in general to the conversion of coal to liquid fuels and more specifically to the removal of suspended mineral matter from coal-derived liquids. For purposes of this invention, coal-derived liquids are defined as the carbonaceous liquid product resulting from the liquefaction of anthracite, bituminous and sub-bituminous coals, lignite, oil shale, tar sands and other solid carbonaceous materials, regardless of the particular liquefaction process used. The suspended mineral matter includes unreacted or incompletely reacted carbonaceous material and inorganic material (normally termed "ash") which includes ironaluminum silicates, pyrites, etc.

A number of processes have been proposed in the prior art for removal of suspended mineral matter from coal-derived liquids. Normally much of the mineral matter is present as particles smaller than 10 microns in diameter. Such processes include sedimentation, filtration and centrifugation. In some instances, additives have been proposed to aid in separation. For example, U.S. Pat. No. 3,852,182 discloses the addition of a "promoter" consisting of a medium boiling fraction of the liquefaction product. In U.S. Pat. No. 3,790,467 solids separation is enhanced by adding both high and low boiling product fractions. In U.S. Pat. No. 3,607,718, unfiltered coal-derived liquid is passed into a settler through a heavy sludge layer to agglomerate particles. In U.S. Pat. No. 3,084,118, a two-component additive comprising a hydrocarbon and sulfuric acid is used.

A number of coal liquefaction processes involve molten salts as hydrogenation catalysts. Such processes typically involve introducing finely ground coal into a continuous phase molten salt at elevated temperature and hydrogen pressure. The gaseous and normally liquid products and unreacted hydrogen are flashed off leaving a molten salt phase and residual liquid. In some such processes ash has been observed to accumulate in the molten salt, causing partial deactivation. See, for example, U.S. Pat. Nos. 3,663,452, 3,790,468 and 3,844,928. In U.S. Pat. No. 3,663,452, coal was mixed in an autoclave under $H_2$ pressure with a relatively large volume of molten salt catalyst. The resulting liquid product was said either to contain no ash or to be readily separable from the ash. In the prior art molten salt processes the primary purpose of the molten salt was to function as a hydrogenation catalyst and as a transport media for coal.

SUMMARY OF THE INVENTION

It is an object of this invention to provide a method of separating particulates from coal-derived liquids which does not require the recycle of large volumes of carbonaceous distillation fractions prior to solids separation.

It is a further object to provide a process employing molten salts which does not require the use of large quantities of the salt as a continuous phase.

It is a further object to provide a coal liquefaction process which utilizes molten salts without resulting in undesired hydrogenation of the liquefaction product.

These and other objects are achieved according to this invention in a process for separating suspended mineral solids from a coal-derived liquid containing said solids comprising the steps of: (a) contacting said coal-derived liquid containing solids with a molten additive having a melting point of 100°-500° C. in an amount up to 50 wt.% with respect to said coal-derived liquid containing solids present, said additive in an amount effective to increase the particle size of said mineral solids and comprising material or mixtures of material selected from the group of alkali metal hydroxides and inorganic salts having antimony, tin, lithium, sodium, potassium, magnesium, calcium, aluminum, zinc, molybdenum, cobalt, nickel, ruthenium, rhodium, beryllium or iron cations and chloride iodide, bromide, sulfate, phosphate, borate, carbonate, sulfite, or silicate anions; and (b) maintaining said coal-derived liquid in contact with said molten additive for sufficient time to permit said mineral matter to agglomerate, thereby increasing the mean particle size of said mineral salts; and (c) recovering a coal-derived liquid product having reduced mineral solids content. In one embodiment contact between the coal-derived liquid and the molten additive is achieved by combining the additive (which can be in solid form) with solid coal and reacting the coal with hydrogen, i.e., a hydrogen-donor solvent or other slurry oil, at a temperature of 200° to 500° C. and a hydrogen pressure of 100 to 4500 psig to provide a coal-derived liquid in contact with the molten additive. Additional heating can be provided if necessary to melt the additive. In another embodiment, coal is liquefied by reaction with hydrogen and the resulting volatile products and unreacted hydrogen are flashed off, leaving a liquid carbonaceous product containing suspended mineral matter. The additive, in solid or liquid form, is added to the carbonaceous liquid and maintained at a temperature above the melting point of the additive. The hydrogen pressure for solids agglomeration is immaterial and may be less than the 200 psig remaining in a typical reaction vessel after the initial volatiles are flashed off or may be less than 0.01 psig, i.e., essentially zero, if the contacting step is to be performed completely separate from the hydrogenation step.

After the coal-derived liquid product having reduced mineral content is recovered, the additive can be separated from the mineral matter and recycled. The molten additive can be filtered to remove the mineral matter and residual additive can be recovered from the mineral matter by aqueous dissolution. The additive can consist of or consist essentially of material selected from alkali metal hydroxides and the above-specified inorganic salts. By "consisting essentially of" it is meant that the additive contains no additional materials such as water in sufficient quantities to interfere or otherwise materially affect the ability of the additive to cause the agglomeration of suspended mineral matter. If desired, the additive can consist entirely of the above-specified materials; that is containing no additional material other than impurities ordinarily associated with the additive compounds. Economics generally favor operation of this process with additive amounts up to only 20 wt.% with respect to coal-derived liquid containing solids, and satisfactory mineral matter agglomeration is achievable with some additives in amounts no more than 5 wt.%.

DETAILED DESCRIPTION

In hydrogen donor or slurry coal liquefaction, crushed coal is reacted in a reactor vessel with hydrogen at a temperature of about 1000°-2000° F. and a pressure of 100 to 4500 psig. The coal is first slurried in a "pasting oil" such as anthracene oil or a hydrogen donor solvent such as tetralin, or other well-known donor solvents, and introduced into the reaction zone. The reaction zone may also contain appropriate catalytic materials. After a residence time of 0.1 to 5 hours in the reaction vessel, coal particles are dissolved, forming liquid hydrocarbonaceous materials. The liquid phase within the reaction vessel, which contains the coal liquefaction product and the pasting oil or hydrogen donor solvent, also contains a significant quantity of suspended solids, which includes inorganic mineral matter (ash, much of which is smaller than one micron), refractory organic material, and in some processes particles of catalytic material. While some of the lighter liquefaction products can be flashed off by reducing the pressure within the reaction vessel, the heavier coal-derived liquid must be separated from the solids prior to further processing or use as a clean boiler fuel. After solids separation, the coal derived liquid can be further processed by any of the methods available in the art of coal liquefaction, including distillation, coking, cracking, etc.

The process of this invention involves the use of certain molten inorganic materials as additives to effect the agglomeration of solid mineral matter suspended in coal-derived liquids. The additives of this invention refer to material in addition to inorganic material which was present in the coal feed. While the function of the molten inorganic additive is not understood in detail, it has been observed that molten inorganic additives wet the iron sulfide, or iron aluminum sulfates and other components of the mineral matter and result in a rapid increase in the mean particle size of suspended solids by agglomeration. When sufficient molten additive is present, at least about 1 wt.% of the carbonaceous liquid containing solids, and the mixture is moderately agitated, much of the solid matter agglomerates into an aggregate, or "clinker," two or more orders of magnitude larger in diameter than the mean particle size of the mineral particles in the absence of the molten salt.

According to this invention, a coal-derived liquid containing suspended mineral solids is contacted with a molten additive having a melting point of 100°-500° C. at a temperature at or above the melting point of the material. Above about 500° C., dissolved coal begins to reagglomerate into solid material. The additive is present in an amount up to 50 wt.% with respect to coal-derived liquid containing solids, which is a substantial departure from prior art molten salt catalytic processes which employ molten salts in an amount greater than the amount of liquefied coal. The additive material of this invention comprises material selected from alkali metal hydroxides and inorganic salts having antimony, tin, lithium, sodium, potassium, magnesium, calcium, aluminum, zinc, molybdenum, cobalt, nickel, rhodium, beryllium, or iron cations and chloride, iodide, bromide, sulfates, phosphate, borate, carbonate, sulfite, or silicate anions, and which individually or in mixtures have melting points below 500° C. Suitable for use in the process are any of these salts or hydroxides or mixtures which, while molten, are capable in amounts no higher than 50 wt.% (with respect to coal-derived liquid containing solids) of agglomerating suspended mineral matter in coal-derived liquids, thereby increasing the mean particle size of suspended mineral solids in a coal-derived liquid relative to the mean particle size of the solids under the same conditions in the absence of the additive. Inorganic salts have antimony, tin, aluminum, zinc, molybdenum, cobalt, nickel, ruthenium, or rhodium cations are catalytic and can result in excess hydrogenation if present during the dissolution (hydrogenation) step. Beryllium compounds are toxic and may be unsuitable in some systems. Iodide and bromide salts are expensive and present handling problems. These problems are avoided when the salts are selected from the group having lithium, sodium, potassium, magnesium, or calcium cations and chloride, sulfate, phosphate, borate, carbonate, sulfite or silicate anions. The amount of additive required to increase the mean particle size of suspended mineral solids will vary among additives, and appears to depend upon the additive's ability to wet mineral particles, e.g., silicate particles, with smaller amounts required of those additives which have a high affinity for mineral particles. Generally, a wt.% of molten additive no greater than the wt.% solids is needed. As a practical matter, the additive should be at least about 5 wt.% of the carbonaceous liquid to facilitate handling, however, as little as 1% of some additives is operative. It is well within the skill of the art to screen hydroxides or salts or salt mixtures within the scope of this invention to determine mixtures which are effective for use in the process and the minimum amount of additive which can be economically handled.

Materials such as nitrates, perchlorates, or chlorates which react chemically with carbonaceous materials and present explosion hazards are unsuitable as additives. Materials such as ammonium sulfate which dissolve in the liquified organic material, are also unsuitable. Extensively hydrated salts such as $Na_2SO_4.10H_2O$ tend to dissolve in their water of hydration at elevated temperature and pressure and fail to mix effectively with the carbonaceous liquid.

Since many of the materials useful in additives are solid at 500° C., suitable mixtures having lower melting points must be used. Examples of suitably low melting eutectic compositions are $CaSO_4/KCl/LiCl$ (m.p. 328° C.), $Na_2Co_3/Na_2SO_4$ (m.p. 330° C.), $KaCO_3/Li_2CO_3/Na_2CO_3$ (m.p. 393° C.), $CaCl_2/LiCl/NaCl$ (m.p. 400° C.), $LiCl/NaCl/KCl$ (m.p. 346° C.), and $NaOH/KOH$ (m.p. $<200°$ C.).

The actual contact between the molten additives and the coal-derived liquid can be achieved in any fashion. For example, solid or molten material can be introduced directly into a vessel containing unfiltered coal-derived liquid at a temperature above the melting point of the additive. The pressure or atmosphere is not material to the solids agglomeration mechanism. Consequently, the additive can contact the coal-derived liquid after volatile products and excess hydrogen have been flashed off and the hydrogen partial pressure is less than 200 psig, or the contact can occur in a substantially hydrogen-free atmosphere, e.g., less than 0.01 psig.

As another embodiment, the hydrogenation reactor can contain both unreacted coal and molten additive, whereby the required contact occurs as the coal-derived liquid is formed, causing the mineral particles to agglomerate as they are formed or freed from the solid coal matrix. In this embodiment, the molten additive is present during hydrogenation. Catalytic salts can promote hydrogenation. The additive can be introduced into the reactor with the coal if desired, for example solid coal can be blended with solid additive of the appropriate composition (i.e. mixed additive powders).

The preferred separation method is to physically decant or siphon off the carbonaceous liquid from the solids which aggregate and become associated with the molten additive. When large amounts of additive are used, usually 10 wt.% or more, the carbonaceous liquid and molten additive phases are allowed to coalesce and the additive can be continuously filtered or otherwise treated to remove the agglomerated solids. If desired, much of the carbonaceous liquid can be vacuum distilled away from the molten salt-containing phase, and the agglomerated solids recovered from the molten additive.

The separated solids fraction, which normally includes carbonaceous solids and residual liquids, is a valuable material. In addition to recoverable quantities of additive, the solids contain as much as 10% of the original chemical energy of the processed coal. It is preferred that the solids be burned (in air for example) to provide process heat or electricity for the liquefaction plant. The residue remaining after combustion, which contains ash and additive, is then dissolved in water or other solvent. The insoluble coal minerals are easily recoverable, for example by filtration through a cloth filter or fine wire mesh. The dissolved additive is recovered from aqueous solution by evaporation or recrystallization and recycled for further use.

The use of the molten additives of this invention is especially useful in connection with the solvent-refined coal (SRC) process. A number of descriptions of the process steps of the SRC process appear in the patent literature, see for example U.S. Pat. No. 4,032,428 issued to George C. Johnson on June 28, 1977 which is incorporated herein by reference. The process of this invention is suitable to replace the separation step of U.S. Pat. No. 4,032,428. It will be apparent to those skilled in the art that any process for liquefaction of coals, lignite, oil shale, tar sands, etc. which involves the separation of suspended mineral solids from a carbonaceous liquid can be readily modified to utilize the molten additive described herein.

In the SRC process pulverized coal is charged and agitated in a solvent comprising the 350°–800° F. boiling fraction of the liquefaction product. Gaseous hydrogen is combined with the slurry and the combined streams enter a preheater and are heated to about 400°–450° C. The preheated slurry is passed to a dissolver operated at 425°–470° C. and 1500–2500 psig under $H_2$ for 30–60 minutes. The effluent from the dissolver is cooled to 280°–315° C. and the vapor phase flashed off by reducing the pressure to about 150 psig. The flashed vapor contains unreacted hydrogen, light hydrocarbon gases, hydrogen sulfide and carbon oxides. The remaining liquid phase is contacted with 5–40 wt.% additive, either premelted or added as a solid, and mildly agitated for about 30 minutes. Since much of the hydrogen has been flashed off, little or no additional hydrogenation of the liquefaction product occurs. Excess hydrogenation after liquefaction is of little or no benefit when the product is a low-melting boiler fuel. Accordingly, for solid fuel production it is preferred that the additive be contacted with the liquefied coal in a hydrogen pressure of no more than 200 psig and a temperature of 150° to 450° C. After about 30 minutes of gentle agitation, e.g. stirring, the suspended mineral matter agglomerates into much larger particles and rapidly settles. The liquefied coal product can be simply decanted off or the liquid phases can be filtered or centrifuged using conventional equipment. Alternatively, the additive-liquified coal mixture can be allowed to sediment until the molten additive phase, which is heavier and contains the aggregated solids, separates. The two-phase mixture can be allowed to cool sufficiently to solidify the additive, permitting easy separation from the carbonaceous liquid. It is preferred, however, that the solids be separated from the bulk of the molten additive prior to solidification to reduce the amount of additive which must be ultimately recovered from the mineral matter.

If the additives are added directly to the solid coal, the mineral solids agglomerate as the coal is liquefied, and can be permitted to settle out with the molten additive phase within the coal dissolver. The additive can be continuously or periodically removed from the dissolver. For example, the ash could be allowed to accumulate within the dissolver (i.e. hydrogenation) vessel for a period of time until it must be physically removed. During removal, the coal slurry feed can be diverted to an alternate reaction vessel.

The amount of agitation which is desirable is readily determinable by trial and error. In the laboratory, it has been found that if agitation is too slow, the particulate mineral matter does not effectively contact the molten additive and solids agglomeration and removal are inefficient. If agitation is too vigorous, the particulates do not agglomerate readily and do not form large discrete agglomerates. If agitation is moderately rapid, very large agglomerates are formed, as large as 6 mm in diameter which rapidly settle and are easily recovered.

The atmosphere under which the molten salt and the liquefied coal are contacted is not critical. In the laboratory the agglomeration process works as well under an inert cover gas as a hydrogen atmosphere. The process can likewise be performed at atmospheric pressure. The following examples of laboratory scale separation illustrate the use of molten additives according to this invention.

EXAMPLE I

Fifty grams of a mixture of LiCl/NaCl/KCl containing 48.3% LiCl, 42.2% NaCl and 9.6% KCl by weight and having a melting point of 346° C. was mixed with fifty grams unfiltered oil from the SRC pilot plant operated at Wilsonville, Ala. A description of the operation of this pilot plant is found in U.S. Energy Research and Development Administration reports FE-2270-15, FE-2270-24 and FE-2270-27, available from National Technical Information Service, Springfield, VA, and herein incorporated by reference. The unfiltered oil was placed in a 1¼-inch diameter by 9-inch long pyrex vessel. The vessel was closed except for a capillary tube for pressure equalization and placed in an autoclave which was pressurized to 100–300 psig in helium or hydrogen atmosphere, heated to 400°–450° C. and rocked gently in a nearly horizontal position for thirty minutes. The autoclave tube was then placed in an upright position and allowed to remain at 400°–450° C. for an additional thirty minutes. The autoclave was then allowed to cool, depressurized, and opened. The tube was opened and the oil was poured off. Gravimetric analysis indicated that the ash content of the oil had been reduced from 2.56 wt.% to 0.07–0.08 wt.%. The solid material in the tube, including frozen salt and settled solids, was washed with organic solvent to remove adhering oil and the salt was dissolved in warm water. The insoluble "clinker" remaining was burned and additional salt leached from it. Salt recovery was greater than 99%. Oil remaining with the clinker was estimated at 5–10% of the SRC charge.

EXAMPLE II

Fifty grams of the ternary alkali-metal chloride salt of Example I and 50 grams unfiltered SRC from the Wilsonville pilot plant and containing 2.56 wt.% solids were placed in a 300 ml. Hastelloy-C autoclave fitted with a 4-paddle stirrer about 6 cm in diameter. The autoclave was sealed, pressurized with helium to 150 psig and heated to 400° C. The mixture was stirred for 30 minutes at 60 rpm and then settled for 30 minutes at 6 rpm. The autoclave was allowed to cool and then opened. The ash content of the oil was found to be 0.023 wt.%. Salt recovery was greater than 99% and loss of oil to the solids was estimated to be 5–10%.

EXAMPLES III–VII

A series of autoclave runs was performed utilizing about 1–10 wt.% additives. The additives were (a) the ternary eutectic of LiCl/NaCl/KCl of Example I, and (b) a 50% KOH, 50% NaOH mixture melting at 170° C. The tests were performed by placing measured amounts of additive and SRC from the Wilsonville plant in an autoclave and heating the autoclave for 120 minutes to about 450° C. and 900–1200 psig pressure for the chloride eutectic and 200° C. and 1200 psig pressure in a helium atmosphere for the hydroxide mixture. For all runs the mixtures were stirred as in Example II at various speeds during the initial 120 minutes. The stirring speed was then reduced to 5–6 rpm for 30 minutes to promote agglomeration of particles and phase separations. The autoclave was cooled and the pressure released. The carbonaceous liquid was siphoned off and analyzed. The results are presented in the table.

Table

| Example | Additive | Unfiltered SRC (g) | Additive (g) | Wt. % Additive Relative to SRC | Wt. % Ash In | Wt. % Ash Out | % Ash Removed |
|---|---|---|---|---|---|---|---|
| III(1) | LiCl/NaCl/KCl | 101.1 | 10.8 | 10.7 | 1.60 | 1.23 | 23.1 |
| IV | LiCl/NaCl/KCl | 97.7 | 10.1 | 10.2 | 1.96 | 0.14 | 92.8 |
| V(2) | LiCl/NaCl/KCl | 98.5 | 1.0 | 1.0 | 1.96 | 0.04 | 97.9 |
| VI(2) | KOH/NaOH | 124.6 | 11.0 | 7.2 | 2.25 | 0.84 | 62.7 |
| VII(2) | KOH/NaOH | 101.7 | 5.5 | 5.4 | 2.54 | 0.15 | 93.1 |

(1)Stirred too slowly to obtain good mixing between additive and SRC
(2)Separation of dry granular coke-like material occured.

In Examples III and IV a bulk phase separation of the molten salt occurred, with the agglomerated particles distributing to the salt phase. In Examples V, VI, and VII, a light porous granular coke-like material separated that appeared to contain most of the mineral matter from the coal. It has been observed that better agglomeration is achieved if additive mixtures are introduced as finely ground particles of premelted eutectics. A run using $NaOH/Na_2SO_4$ was unsuccessful, presumably due to the use of large additive particles.

A blank run without additive was performed by placing the SRC in a glass capsule within a pressurized autoclave. After the same heating and agitation sequence that had resulted in particle agglomeration when molten LiCl/NaCl/KCl was present, the ash content and physical appearance of the SRC were essentially unchanged. Another such blank run was performed in a metal walled autoclave that had previously been used for runs employing a molten salt additive. At the completion of the run, a small amount of more viscous material was found on the walls of the autoclave. This material contained about Δ of the total inorganic ash and is believed to have been formed as a result of wall effects or traces of residual salt from previous runs.

Based upon the teachings herein, workers in the art can select effective additive mixtures from the hydroxides and salts described herein by routine screening tests using unfiltered coal-derived liquids and amounts of additive up to about 50 wt.%. It is expected that additional inorganic compounds or mixtures will be found which can function in the same manner as the additives of this invention and such compounds and mixtures are contemplated as equivalents of those disclosed and suggested herein.

What is claimed is:

1. A process for separating suspended mineral solids from a coal-derived liquid containing said solids comprising the steps of:

(a) contacting said coal-derived liquid containing said solids with a molten additive having a melting point of 100°–500° C. in an amount up to 50 wt.% with respect to said coal-derived liquid containing said solids, said additive being present in an amount effective to increase the particle size of said mineral solids and comprising material or mixtures of material selected from the group of inorganic salts having antimony, tin, lithium, sodium, potassium, magnesium, calcium, beryllium, aluminum, zinc, molybdenum, cobalt, nickel, ruthenium, rhodium or iron cations and chloride, iodide, bromide, sulfate, phosphate, borate, sulfite, or silicate anions; and (b) maintaining said coal-derived liquid in contact with said molten additive at said temperature range for sufficient time to permit said mineral matter to agglomerate, thereby increasing the mean particle size of said mineral solids; and (c) recovering a coal-derived liquid phase from said contacting having reduced mineral solids content.

2. The process of claim 1 wherein said contacting step is performed by combining said additive with solid coal and reacting said coal with hydrogen at a temperature of 200° to 500° C. and a hydrogen pressure of 100 to 4500 psig for sufficient time to provide said coal-derived liquid containing said suspended solids in contact with said additive and at a temperature above the melting point of said additive.

3. The process of claim 1 wherein said contacting step is performed in an atmosphere containing less than about 200 psig hydrogen partial pressure.

4. The process of claim 1 wherein said contacting step is performed in an atmosphere containing less than 0.01 psig hydrogen partial pressure.

5. The process of claim 1 further comprising separating mineral solids from said additive recovered from step (c) and then recycling said additive to said contacting step.

6. The process of claim 1 comprising (d) separating accumulated mineral solids from molten additive recovered from step (c) to provide separated solids containing carbonaceous material and residual additive, (e) burning carbonaceous material in said separated solids leaving a residue comprising additive and ash, (f) contacting said residue with an aqueous liquid to dissolve said additive, (g) recovering the dissolved additive from the solution produced in step (f) and recycling the recovered additive to step (a).

7. The process of claim 1 wherein said additive is present in an amount up to 20 wt.% with respect to said coal-derived liquid containing solids.

8. The process of claim 1 wherein said additive is present in an amount no greater than 5 wt.% with respect to said coal-derived liquid containing solids.

9. The process of claim 1 wherein said additive comprises a mixture of material selected from the group of inorganic salts having lithium, sodium, potassium, magnesium, or calcium cations and chloride, sulfate, phosphate, borate, carbonate, sulfite or silicate anions.

10. The process of claim 1 wherein said additive comprises a mixture of sodium chloride, lithium chloride, and potassium chloride.

11. The process of claim 1 wherein said coal-derived liquid in contact with said molten additive is agitated to cause said mineral matter to form aggregates at least 2 orders of magnitude larger in diameter than the mean particle size of said mineral solids prior to said contacting step.

12. The process of claim 1 wherein said additive is present in an amount up to 50 wt.% with respect to said coal-derived liquid containing said solids and no greater than the weight percent of solids in said coal-derived liquid.

13. The process of claim 2 in which said contacting step is performed by adding said molten additive to said coal-derived liquid only after said coal-derived liquid is formed.

14. The process of claim 2 in which said contacting step is performed under conditions wherein little or no hydrogenation of said coal-derived liquid occurs.

15. A process for separating suspended mineral solids from a coal-derived liquid containing said solids comprising the steps of:

(a) contacting said coal-derived liquid containing said solids in an atmosphere containing less than about 200 psig hydrogen partial pressure, with a molten additive having a melting point of 100–500 in an amount up to 50 wt.% with respect to said coal-derived liquid containing said solids, said additive being present in an amount effective to increase the particle size of said mineral solids and comprising material or mixtures of material selected from the group of alkali metal hydroxides or inorganic salts having antimony, tin, lithium, sodium, potassium, magnesium, calcium, beryllium, aluminum, zinc, molybdenum, cobalt, nickel, ruthenium, rhodium, or iron cations and carbonate anions;

(b) maintaining said coal-derived liquid in contact with said molten additive at said temperature range for sufficient time to permit said mineral matter to agglomerate, thereby increasing the mean particle size of said mineral solids; and (c) recovering a coal-derived liquid phase from said contacting having reduced mineral solids content.

16. The process of claim 15 in which said contacting step is performed in an atmosphere containing less than 0.01 psig hydrogen partial pressure.

17. The process of claim 15 in which said additive consists essentially of material or mixtures of material selected from the group of alkali metal hydroxides.

18. The process of claim 15 wherein said additive is present in an amount up to 20 wt.% with respect to said coal-derived liquid containing solids.

19. The process of claim 15 wherein said additive is present in an amount no greater than 5 wt.% with respect to said coal-derived liquid containing solids.

20. The process of claim 15 wherein said coal-derived liquid in contact with said molten additive is agitated to cause said mineral matter to form aggregates at least 2 orders of magnitude larger in diameter than the mean particle size of said mineral solids prior to said contacting step.

21. The process of claim 15 wherein said additive is present in an amount up to 50 wt.% with respect to said coal-derived liquid containing said solids and no greater than the weight percent of solids in said coal-derived liquid.

22. The process of claim 15 in which said contacting step is performed under conditions wherein little or no hydrogenation of said coal-derived liquid occurs.

* * * * *